United States Patent [19]

Barker et al.

[11] Patent Number: 4,979,576

[45] Date of Patent: Dec. 25, 1990

[54] PERCUSSION CORE GUN CONSTRUCTION AND CABLE ARRANGEMENT

[75] Inventors: James M. Barker, Katy; Martin L. Tomek, Houston, both of Tex.

[73] Assignee: Halliburton Logging Services Inc., Houston, Tex.

[21] Appl. No.: 476,846

[22] Filed: Feb. 8, 1990

[51] Int. Cl.[5] ..... E21B 49/04

[52] U.S. Cl. ..... 175/4; 175/58

[58] Field of Search ..... 175/58, 4, 20, 403, 175/405

[56] References Cited

U.S. PATENT DOCUMENTS

| | | | |
|---|---|---|---|
| 3,517,756 | 6/1970 | Goss | 175/4 |
| 4,280,568 | 7/1981 | McPhee et al. | 175/4 |
| 4,569,403 | 2/1986 | Barrett | 175/4 |
| 4,702,327 | 10/1987 | Barrett | 175/4 |
| 4,750,570 | 6/1988 | Barrett | 175/4 |
| 4,827,823 | 5/1989 | Barrett | 175/4 |

*Primary Examiner*—Ramon S. Britts
*Assistant Examiner*—Terry Lee Melius
*Attorney, Agent, or Firm*—William J. Beard

[57] ABSTRACT

An elongate gun assembly with multiple gun chambers is assembled with locking keys holdinhg several chambers in place. In each, a bullet with bottom is placed adjacent to an explosive charge. An elongate cable having two end loops connects with the assembly and passes through the bullet. The cable is anchored on the bullet, and the two ends are unequal in length. They enable retrieval after firing. A method of cable coiling and retrieval is set out.

5 Claims, 2 Drawing Sheets

FIG.1
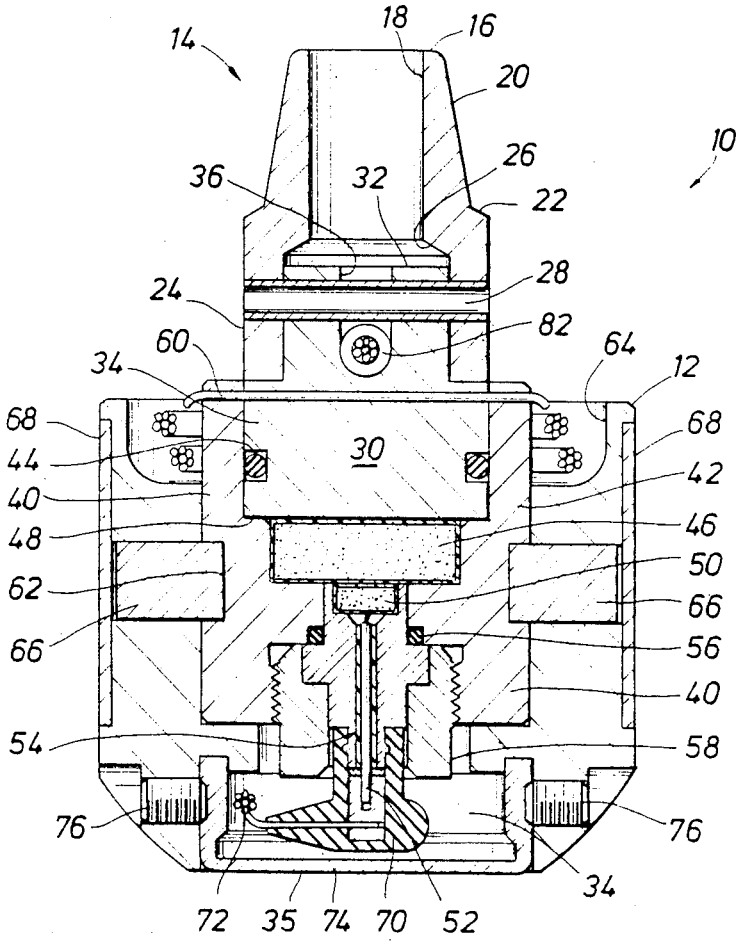
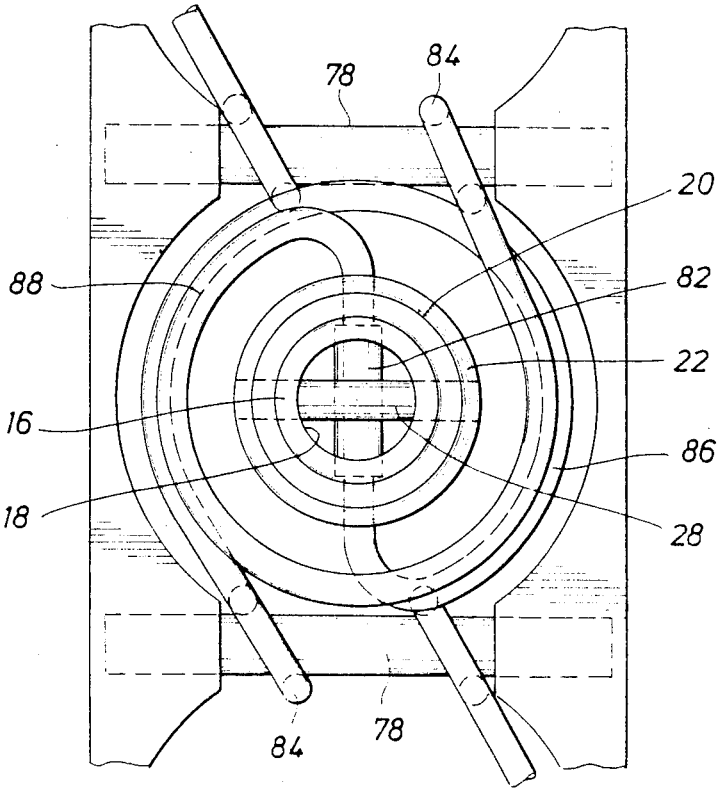
FIG. 2

PERCUSSION CORE GUN CONSTRUCTION AND CABLE ARRANGEMENT

BACKGROUND OF THE DISCLOSURE

A percussion core gun is a core sample taking device which cuts a cylindrical divot from the side wall in an open borehole condition. It is used in a borehole where a core gun supporting body is positioned on a cable, and is lowered to a specified depth or elevation, and a bullet shaped core barrel is propelled by explosives radially outwardly into the wall, cutting a divot which is jammed into and received within the cylindrical cavity for sample storage. Thereafter, the entire mechanism is retrieved to the surface. The core gun fires an assembly which will be described hereinafter as the core barrel, and that in turn is plugged at the back end by a plug or bottom assembly, the two generally being pinned together. They are fired as a unit by initiation of an explosive positioned beneath the barrel and bottom assembly and surrounded by an enclosure which will be defined as the firing chamber. The chamber is sealed by means of an external O-ring on the core barrel or bottom thereof.

The equipment making up the present apparatus ideally is used repetitively. However, it is fabricated in multiple components for easy replacement. The core barrel is subject to substantial wear and tear because it is fired with tremendous momentum, impacting the adjacent sidewall and may wear from that. The present apparatus sets forth a construction of core barrel, plug or bottom and explosive chamber that are supported on a common tool body. Of necessity, some, perhaps most of these components must be made of extremely high quality metals subject to subsequent heat treatment. This is necessary to withstand the shock of use in operation. The parts must be assembled into a close fit and hence precise fabrication is required. Moreover, the precise manufacturing requirements, the hard metals typically used, and the shape of the products define a somewhat expensive manufacturing process. The present apparatus sets forth a type of modular chamber and core barrel and bottom assembly that will readily fit in a bore which is not made with great precision and which is retained therein by locking keys. This markedly reduces the cost of manufacture and also provides quick replacement of chambers or core barrels, depending on the location of wear.

There is another requirement imposed on a percussion core gun assembly. This relates primarily to pulling the core containing barrel free from the adjacent side wall. Retrieval is a problem. It should be recalled that retrieval must be accomplished with downhole equipment without observation. To this end, a retrieval cable must be attached to the core barrel for retrieval to the gun assembly. A new and improved arrangement of the cable and anchoring the cable at two ends thereof to the gun while looping the cable through the barrel is set forth. A clamp located on the cable offset from the center thereof is incorporated. This assists in defining the cable into two separate cable segments which are dissimilar in length. The two cable lengths cooperate with end located eyelets for anchoring purposes so that a first cable is pulled. If that cable section breaks, there remains a second cable for pulling. That is located so that the second cable can pull at a different angle, and thereby more readily dislodge the stuck core barrel.

Such a cable arrangement is also useful at the time the core gun is operated to fire the core barrel in a washout zone. Washouts may occur where the diameter of the borehole is quite large, sufficiently large that the core barrel is unable to make operative connection with the sidewall. In that instance, the core barrel will be fired at some substantial velocity, and travel to the end of its tether, and likely break one of the two segments of the cable which anchor the core barrel. When this occurs, the first may break, but the second cable, being somewhat longer, will tend to hold the core barrel and enable its retrieval. The first cable segment may break because it is shorter but it absorbs substantial energy and reduces the velocity so that the second cable segment is permitted to retrieve the core barrel.

The cable connector of the present disclosure sets forth a simple cable which has eyelets at both ends and a sleeve crimped at a central portion but located away from the precise center. This cable connection arrangement thus provides greater reliability in retrieval after firing.

While the foregoing sets out certain problems and describes somewhat the features of the present apparatus, greater understanding thereof will be obtained on review of the drawings found below so that the detailed description of the preferred embodiments can be understood.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

FIG. 1 is a sectional view through a core barrel and bottom as a unit and supported by a gun assembly enclosing a powder charge for propelling the core barrel against the adjacent sidewall to obtain a sample;

FIG. 2 is a plan view of the structure shown in FIG. 1 particularly showing the coiling of the retrieval cable in accordance with the teachings of the present disclosure;

DETAILED DESCRIPTION OF THE PREFERRED EMBODIMENTS

Figure 3:
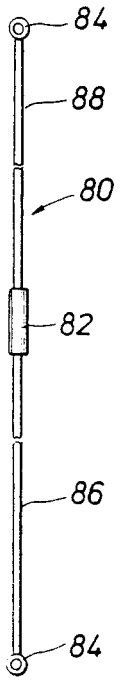
FIG. 3 is a simplified view of the cable shown straight and certain lengths are marked thereon for assistance in the description.

Attention is now directed to FIG. 1 of the drawings where the numeral 10 identifies a core gun supported on an assembly 12 for obtaining a core sample. The gun assembly 12 is quite long and can support one or more similar core barrels which are to be fired for obtaining one or more samples. They are all identical except for location along the firing gun assembly. It is an elongate body supporting one or more core barrels directed radially outwardly for obtaining samples. The elongate assembly 12 is supported on a logging cable when it is lowered into a well borehole. The logging cable typically extends to the surface and passes over a sheave. The cable is stored on a large drum or reel and cable is spooled onto the drum during retrieval. The device 12 is lowered to a specified depth in the well borehole and a signal is applied which fires or initiates one or more of the core guns to obtain specimens.

The core barrel 14 is an axially hollow container for receiving and holding a circular divot of sidewall material. It has a nose 16 which is circular to cut a circular sample, and the tip is formed into an edge, but not a sharpened edge. It tends to cut a plug of sample material which is received axially in the cylindrical storage chamber 18 symmetrical along the centerline axis of the core barrel 14. The barrel wall is defined by the circular inner wall and the arcuate outer wall 20, and increases in thickness back to a shoulder 22. The internal chamber 18 is axially formed within the cylindrical wall and is adapted to form a storage chamber for receipt of the cylindrical plug or sample. The enlargement at the outer shoulder 22 defines an encircling collar which limits penetration.

The core barrel 14 terminates in a lower surrounding skirt 24 which is axially drilled at the lower end. The interior includes a limit shoulder 26 within the core barrel which enables the barrel bottom or plug 30 to be pinned to the core barrel. The plug 30 plugs the back end of the core barrel. The plug 30 is constructed with an upstanding cylindrical body 32, and the upstanding body 32 is attached and integrally constructed with a larger cylindrical lower body portion 34. These two bullet components are joined together by a transverse pin 28 which is known as a roll pin. This pin 28 fits snugly in the opening provided to hold the two components together. The roll pin 28 is at right angles to a cable slot 36. The slot 36 is shaped to receive a crimped sleeve about the cable as will be described. Moreover, the cable is at right angles (see FIG. 2 of the drawings) beneath the roll pin 28 and is locked in that position as will be described. In other words, the cable cannot slide to and fro in the slot 36. Movement is prevented because the sleeve affixed to the cable is sufficiently large in diameter that it will lock, thereby preventing sliding movement.

The bullet bottom 30 fits within the gun chamber 40. This has an upstanding skirt 42 which encircles the bullet bottom 30 and which is sealed therewith by means of an O-ring 44. The O-ring isolates the chamber below the bullet bottom 30. The chamber receives a prepackaged cartidge of explosive material. The package 46 is sized to fire the projectile in a fashion to be described. Thus, the bullet bottom 30 abuts an internal shoulder 48, and the shoulder aligns the bullet bottom 30 so that the powder in the form of a cylindrical cartidge is positioned and centered below the bullet bottom 30. The cartridge is a typical explosive suitable for this purpose which is wrapped in a plastic or impregnated shell. The main charge is immediately adjacent to a smaller charge 50 which is an ignition charge. That charge is in contact with a bridge wire which is connected to a conductor 52 which extends through a narrow passage in a hermetic igniter plug 54. The plug 54 supports the ignition mix 50 in a centralized location for initiation. An O-ring 56 provides a fluid tight seal when subjected to axial loading by the threaded nut 58 which is threaded into the gun chamber to thereby position the igniter in the right location. The foregoing structure incorporating the O-ring seals 56 and 44 provides a sealed chamber for the explosives. When initiated, the bullet is fired by the explosion. Prior to firing, the bullet is held in place by a sacrificial shear pin 60. It is of light weight metal and has a small diameter so that it is readily broken when the bullet is fired.

The gun chamber 40 has a circular groove formed in the exterior at 62. This groove 62 is included for locking the gun chamber in place. Thus, the elongate tool 12 is formed of an elongate body as priviously mentioned which holds many similar gun barrels, each with its own chamber and each having means for supporting and aligning the coring barrel for firing as a projectile. FIG. 1 therefore includes the elongate body which is drilled with appropriate holes to receive the chamber 40 therein. It is nested in the elongate body 12. It is surrounded by a recessed cavity 64; the cavity is sized to receive the retrieval cable which will be discussed in detail hereinafter. The elongate body 12 has lengthwise rectangular slots or grooves therein to receive locking keys 66 which pass through the mating grooves to secure the chamber 40 in place. It will be appreciated that the core sample gun assembly can be several feet in length. The locking keys need not be that long, but they can be sufficiently long to span one or several chambers 40 and lock each in place along the core sample gun assembly 12. The locking keys are placed in position by removing and reinstalling adjacent side walls 68. The side walls cover the locking keys so that, on assembly, the keys can be inserted and then locked in position. The side plates 68 provide for this.

As further noted, the wire 52 extends downwardly and clear of the support structure. It is preferably covered with an insulate rubber boot 70 and connects to a wiring harness 72 so that individual firing signals can be applied to more than one of the core sample guns. In other words, the wiring harness 72 includes an individual conductor to each of the core guns supported on the core gun assembly 12. The wiring harness 72 is covered over by a plate 74 which has parallel edges, and which is locked in place by set screws 76 at spaced locations along the length. Similar set screws can be used to fasten the side plates 68 in position.

The foregoing fairly well describes the structure of the core gun and particularly the barrel, the bottom and the gun chamber. Going to certain details thereof, it will be noted that a precision fit is not required on the exterior of the gun chamber 40. It must be accurately drilled to receive the core barrel, but a tight seal is assured through the use of the O-ring. This reduces the cost of manufacture and enables a less expensive manufacturing process to be used. Moreover, the threaded nut 58 is included primarily for the purpose of securing a tight seal where the O-ring 56 is compressed.

From the foregoing, it will be observed that all the components are easily manufactured with relatively routine manufacturing procedures and the tolerances required in manufacture are reasonable. There are threaded connections between the components 40, 54 and 58 that are relatively easy to machine.

RETRIEVING CABLE CONNECTION WITH THE CORE GUN ASSEMBLY

Attention is now directed to FIG. 2 of the drawings which shows the structure of FIG. 1 in plan view. There, the core gun assembly 12 is shown with a single core gun perpendicular to the drawing, but it will be understood that the core gun is repeated along the length of the structure. Of particular importance are the transverse keeper pins 78 spaced above and below each core gun. They are replicated so that each core gun is adjacent to one above and one below. Each pin, however, cooperates with two core guns and therefore each pin serves as an anchor for two retrieving cables. FIG. 3 shows a retrieving cable 80. The retrieving cable 80 has a sleeve 82 which is crimped onto the cable. The cable terminates at identical eyelets 84, each sized to fit on the keeper pins 78 just mentioned. There are certain lengths to be noted regarding the retrieving cable. First of all, it has a central sleeve 82 which is fixed to it and which is not slideable. The sleeve 82 is located at the central portion, but, as explained below, care should be taken to position it off center.

There is a lower cable section 86 and an upper cable section 88. The cable section 86 is longer than the cable section 88. The difference in the length of the two should be sufficiently great that the shorter of the two can stretch tight without placing tension on the other of the two assuming that the core barrel has been fired radially outwardly from the supporting gun assembly 12. Consider now the placement of the cable segments. The sleeve 82 is shown in FIG. 2 of the drawings. It is sized so that it fits in the bottom 30 when it is latched in the slot 36 and is not free to slide to the left or the right. Each cable segment 86 and 88 wraps almost one full revolution around the gun barrel, noting FIGS. 1 and 2. Recall that both ends of the retrieving cable terminate at eyelets 84. These are looped around the adjacent keeper pins 78. One is above and the other is below so that both ends of the cable are anchored. The two anchored ends thus provide fixed attachments for the bullet after firing and this further enables retrieval in the intended fashion. When the core barrel is fired, the cable is straightened into two segments which requires approximately one full revolution of the core barrel. The spacing of the firing mechanism from the side wall is such that this is normally accomplished at or about the time of impact. In the event that the revolution is not accomplished, even partial rotation may occur. In any case, the impact will normally embed the fired projectile in the side wall. This will occur even in formations where the material is friable such as certain limestones. In unconsolidated formations, there may be a different type of impact, e.g., as sand particles erode around the point of impact. In any event, impact occurs and embedment follows so that the projectile must be pulled free thereafter.

Figure 4:
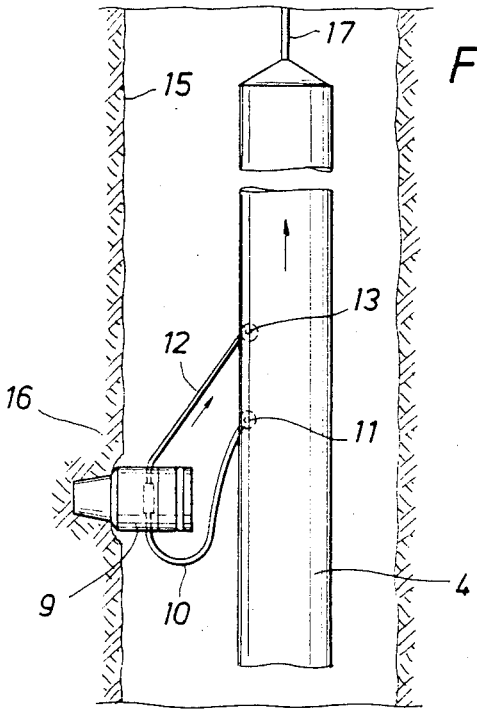
FIG. 4 shows retrieval of the core barrel after taking a sample from the adjacent sidewall wherein the pull is on one side of the cable.
Figure 5:
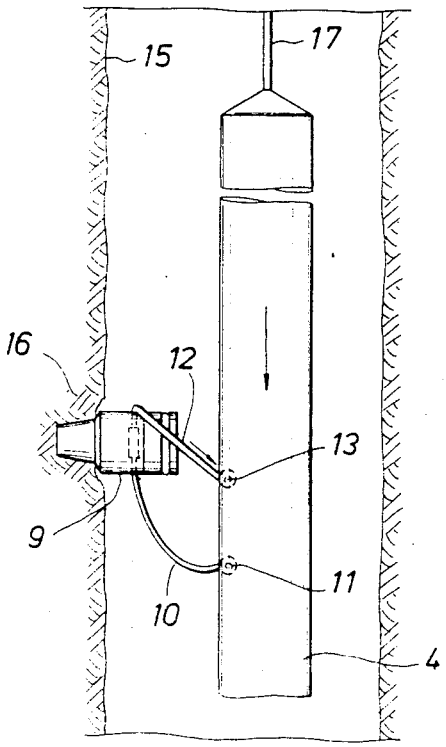
FIG. 5 is a view similar to FIG. 4 wherein the logging cable suspended equipment is lowered to place the tension on the retrieval cable differently than shown in FIG. 4 and to assist in bullet retrieval.
Figure 6:
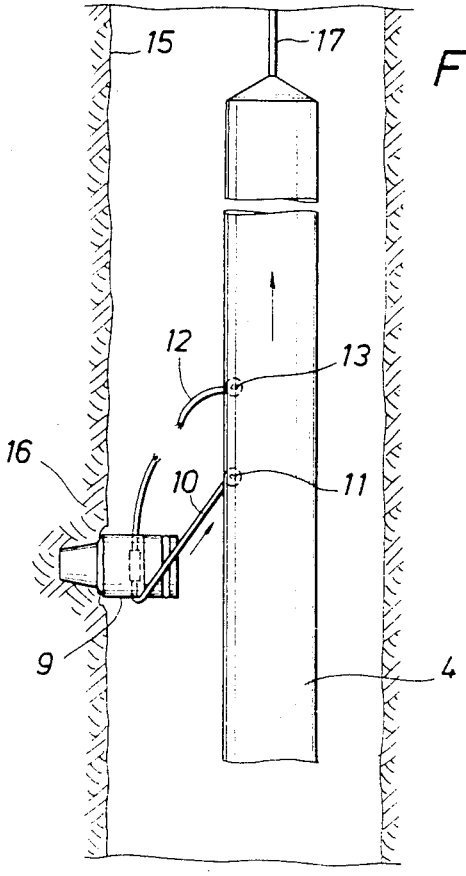
FIG. 6 is a view similar to FIG. 4 showing another mode of retrieval after breaking the retrieval cable at one location.

Attention is directed jointly to FIGS. 4, 5 and 6 which show various pulling techniques. Recall that one of the two cable segments is shorter than the other. Tension is taken on the retrieving cable by virtue of moving the gun firing assembly 12 up or down in the well. FIG. 4 shows one instance where the retrieving cable is taut in the top segment only but is unloaded in the lower cable segment. This permits a strong tug to be taken, and indeed, should the cable break under load, this will nevertheless typically dislodge the bullet at least to some extent. Further continued upward movement of the gun assembly will place tension on the lower segment and typically will dislodge the embedded bullet and accomplish retrieval on the remaining unbroken retrieving cable segment.

By contrast, downward motion is shown in FIG. 5 and is an alternate way of breaking the bullet free from the adjacent formation. FIG. 5 shows an approach whereby the bullet is pulled downwardly with a kind of twisting movement which assists in dislodging the bullet. Inevitably, there is the risk that the shorter cable segment will break. FIG. 6 represents this where the short segment has been broken by the first pulling action. FIG. 6 can be contrasted with FIG. 4 to show how continued upward movement, even after breaking of one cable segment likely will accomplish retrieval. In practically all occasions, the bullet can be retrieved, either on the upward or downward stroke of the cable supported gun assembly. In practically all occasions, the bullet can be retrieved on the retrieving cable, perhaps at the risk of breaking one side or the other, but not both.

Consider the possibility that the bullet is fired radially outwardly at a washout. In that instance, the kinetic energy of the bullet traveling at substantial velocity with significant weight often will break the retrieving cable. That, however, is not a great problem because the shorter segment of the retrieving cable will break on absorbing a tremendous amount of the energy. This enables the bullet to be retrieved on the longer of the two segments. Ordinarily the bullet velocity is not so great that both cable segments will break. The shorter cable segment is typically used sacrificially to absorb the kinetic energy of the bullet and retrieval is still accomplished. Since a washout can occur in a fashion that is difficult to predict from the surface, it is not uncommon to fire the bullet at an elevation in the well borehole at which a washout has occurred, thereby defeating sample retrieval. In that instance, it still is desirable that the bullet be retrieved for subsequent reuse. Even where the bullet does not return with the core sample, it can be recycled by reloading and refiring.

While the foregoing is directed to the preferred embodiment, the scope thereof is determined by the claims which follow.

What is claimed is:

1. Apparatus for obtaining core samples from the sidewall of a well borehole, comprising:

(a) an elongate core gun carrier sized and adapted for passage through a well borehole, said carrier having multiple longitudinally spaced apart recesses therein each of which is sized and adapted to receive a single core sampling cutter and an explosive charge for propelling said cutter radially outwardly from said carrier into the wall of the well borehole;

(b) said core sampling cutter comprising an elongate hollow sample storage means and having a nose shaped for cutting a core sample and admitting the sample into said storage means comprising a hollow cavity extending through said sampling cutter and being a generally elongate cylindrically shaped hollow body;

(c) a separate bottom member for closing the bottom end of said sample storage means and means for removably attaching said bottom member to said cutting nose of said core sampling cutter, said bottom member being releasably attached to said carrier;

(d) a single retrieval cable passing through said sampling cutter and having affixed thereto means for anchoring said retrieval cable to said sampling cutter with unequal length segments of said cable extending from opposite sides of said cutter;

(e) means for anchoring the ends of said unequal length segments of said retrieval cable to said carrier body on the same longitudinal axis above and below the location of said recesses therein; and (f) whereby when said sampling cutter is propelled outwardly into engagement with the wall of the well bore, said two unequal length segments of said retrieval cable are each attached to it and can exert independent or cooperative forces on it as said carrier body is moved vertically through the borehole.

2. The apparatus of claim 1 wherein said unequal length segments of said retrieval cable are formed into lengths positioned one above and one below said sampling cutter in said carrier recesses prior to the firing of said cutter.

3. The apparatus of claim 2 wherein said sampling cutter anchoring means to said cutter includes a sleeve fixedly attached to the portion of said retrieval cable passing through said sampling cutter and sized to not pass through the openings in said sampling cutter through which said cable passes.

4. The apparatus of claim 3 and further including explosive means in said bottom member for propelling said sampling cutter into engagement with the wall of the well bore, and means for fluid tight sealing of said explosive means from borehole fluid.

5. The apparatus of claim 4 wherein said bottom member is attached to said recesses in said carrier body by positioning an aligning pin in an opening therefore in said carrier body.

* * * * *